United States Patent [19]

Molins et al.

[11] 3,948,389

[45] Apr. 6, 1976

[54] PACKETS

[75] Inventors: Desmond Walter Molins; Robert William Davies, both of London, England

[73] Assignee: Molins Limited, London, England

[22] Filed: Apr. 22, 1974

[21] Appl. No.: 462,919

[30] Foreign Application Priority Data

Apr. 26, 1973 United Kingdom..... 20008/73

[52] U.S. Cl. ..... 206/245; 206/259; 206/268; 229/44 CB; 229/87 C

[51] Int. Cl.[2] ..... A24F 15/12; B65D 5/10

[58] Field of Search ..... 229/44 CB, 87 C; 206/259, 206/261, 268, 273, 245

[56] References Cited

UNITED STATES PATENTS

| | | | |
|---|---|---|---|
| 453,264 | 6/1891 | Maloney | 229/87 C |
| 2,874,524 | 2/1959 | Ringler | 229/44 CB X |
| 2,950,043 | 8/1960 | Ringler | 229/44 CB |
| 3,333,683 | 8/1967 | Scharre | 229/87 C X |

FOREIGN PATENTS OR APPLICATIONS

| | | |
|---|---|---|
| 493,315 | 10/1938 | United Kingdom |

*Primary Examiner*—William Price
*Assistant Examiner*—Stephen P. Garbe
*Attorney, Agent, or Firm*—John C. Smith, Jr.

[57] ABSTRACT

A cigarette packet is closed at one end by an air impervious tube which is sealed flat, the resulting margin and triangulated ends being folded against the packet. In one packet the tube extends to both ends of the packet, which are sealed in the same manner; in a second packet the middle part of the tube is omitted and replaced by a tubular body of card and aluminium foil; and in a third packet one end is closed by a foil cap. The packets described may be used inside a conventional hinged lid packet.

5 Claims, 7 Drawing Figures

PACKETS

This invention concerns improvements in or relating to packets for containing articles to be protected from the atmosphere, in particular smoking articles such as cigarettes.

In U.S. application Ser. No. 417,646 filed Nov. 20, 1973, now abandoned, there is disclosed a cigarette packet for keeping the contents fresh without requiring an overwrap of cellophane or other non-decomposable material around the packet.

According to the present invention there is provided a method of forming a packet made of an air-impervious sheet material around at least one end face of a substantially cuboid article, comprising the steps of forming the sheet material into a rectangular tube to overlap said end face, sealing the free end of the tube flat up to said end face along a central plane parallel to one of the sides of the tube, folding over the resulting sealed margin of double thickness material against said end face, and folding back the triangulated portions at the ends of the margin.

It will be understood that the article herein mentioned may comprise a group of articles, for example cigarettes.

The invention also provides a packet for a substantially cuboid article comprising an air impervious tube of rectangular section overlapping at least one end face of the article, the free end of the tube being sealed flat up to said end face along a central plane parallel to one of the sides of the tube thereby forming a sealed margin of double thickness, the margin and the triangulated portions at the ends thereof being folded over against the article.

The tube may be formed from a laminated sheet of paper and aluminium foil which is longitudinally sealed.

The invention also extends to the combination of such a packet and a conventional hinged lid packet for containing the packet.

Figure 1:
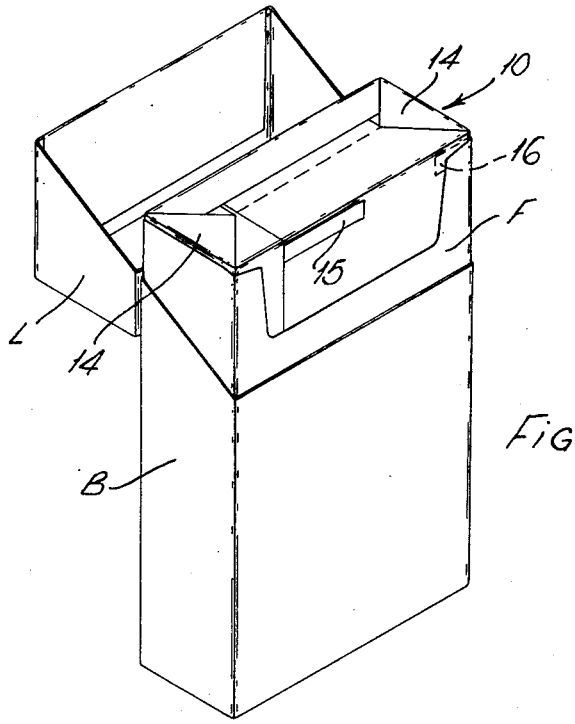
Figure 2:
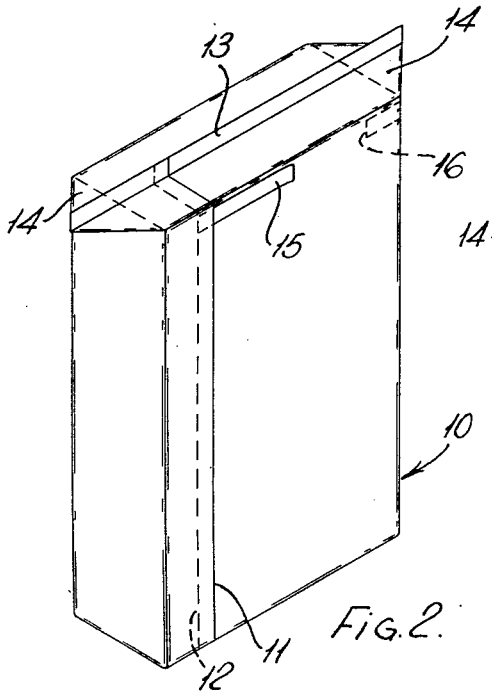
Figure 3:
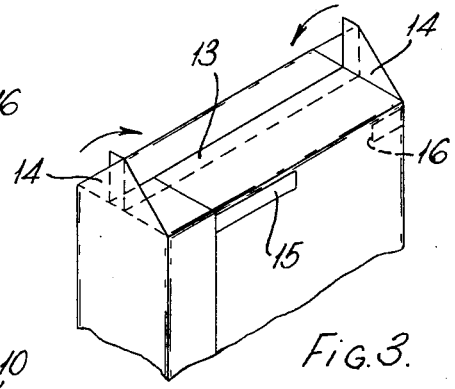
Figure 4:
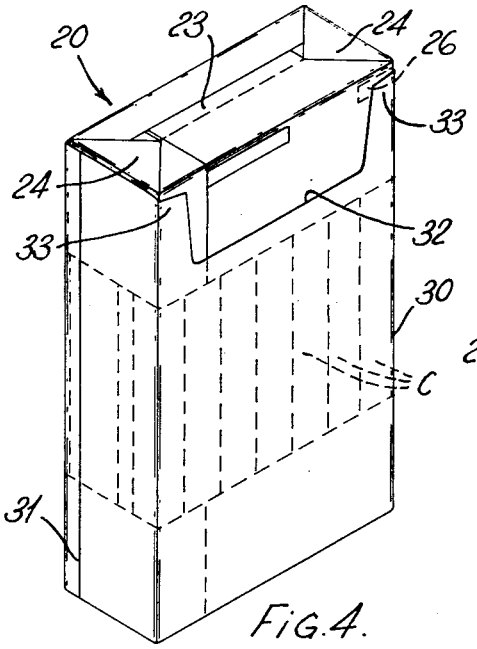
Figure 5:
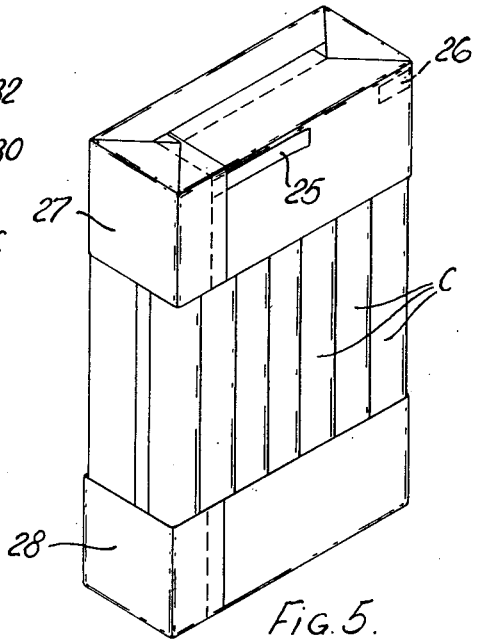
Figure 6:
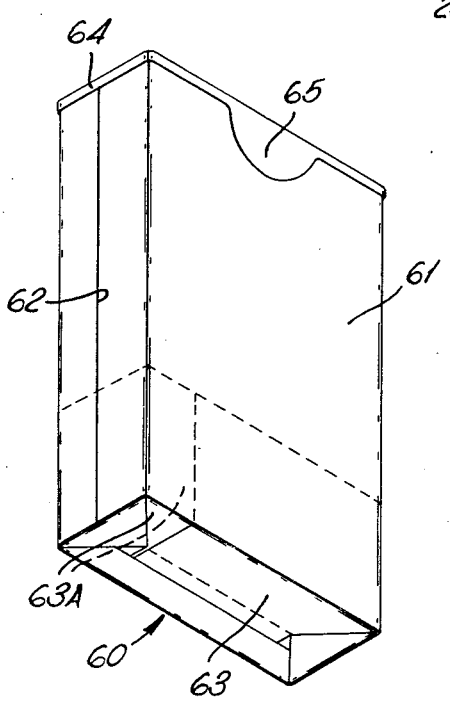
Figure 7:
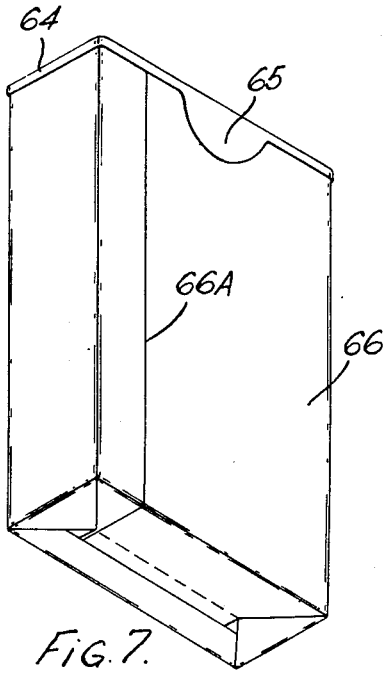

Various embodiments of the invention will now be described, by way of example, with reference to the accompanying drawings in which:

FIG. 1 is a perspective view of a packet according to one embodiment of the invention, FIGS. 2 and 3 are views showing the formation of the top of the packet of FIG. 1, FIG. 4 is a perspective view of a packet according to a second embodiment, FIG. 5 is a view similar to FIG. 4 but with the outer tubular body removed, FIG. 6 is a perspective view, as seen from underneath, of a packet according to a third embodiment, and FIG. 7 is a modification of the packet of FIG. 6.

In the cigarette packet shown in FIG. 1 an inner packet 10 is contained in a conventional hinged lid packet having a body B, a lid L and an inner frame F. As best seen in FIG. 2, the packet 10 is made from a blank of air impervious sheet material formed into a tube of rectangular section and having one longitudinal margin 11 overlappingly sealed to the other margin 12. The material of the blank is a laminate of paper and aluminium foil, the latter facing the inside of the packet.

When the packet has been filled with cigarettes the top margin 13 of the tube is adhesively sealed along a plane passing midway between the front and back sides of the tube, and the margin is then folded back to lie flat above the top of the cigarettes. The resulting triangular portions 14 at the ends of the margin 13 are then also folded over, as shown in FIGS. 3 and 4, to lie against the top of the cigarettes. Alternatively, the triangular portions 14 could, in certain conditions, be folded in the opposite direction, i.e. against the sides of the tube.

A tear tape 15 extends between the margins 11 and 12 and is secured to the inside of the top of the tube. The tear tape does not extend fully around the tube but ends at a point 16. When the packet 10 is in position in the hinged lid packet and the top of the packed is opened by pulling the tape 15 around to the point 16, the cut-out in the rigid inner frame F can then be used as an edge against which the corresponding front portion of the tube is torn away.

The bottom of the packet is formed similarly to the top, though before the cigarettes are inserted, by the use of a mandrel (not shown) on which the tube itself may be formed. The mandrel is positioned in the tube to within the correct distance away from the bottom of the tube, so that the bottom margin can be adhesively sealed and folded against the bottom of the mandrel in a similar manner to that described for the top of the tube.

In the second embodiment shown in FIGS. 4 and 5 certain parts of the packet 20 are similar to those of packet 10, and have therefore been designated by the same reference numerals increased by 10. In these figures the cigarettes are indicated at C. Thus the top and bottom of the packet 20 are similar to that of packet 10; but instead of being made of a single blank, the inside of the packet 20 is made of a separate top and bottom blanks formed into tubes 27 and 28 spaced apart by a gap as best shown in FIG. 5.

A tubular body 30 (FIG. 4), made of an air impervious laminate of card and aluminium foil, extends from the top to the bottom of the packet 20 and is longitudinally sealed at 31 and adhesively secured around each of the tubes 27 and 28, thereby bridging the gap between them. At the front of the body 30 is a cutout 32 similar to that of the frame F of FIG. 1. The packet 20 can then be inserted into a hinged lid packet as shown in FIG. 1, but in which the inner frame F is omitted. The tear tape 25 again only extends to a point 26 to the right of the cutout 32, as described above. As with the inner frame F, the top portions 33 on the body adjacent the cut-out 32 provide a locking action for the cooperating hinged lid. The cut-out 32 can again be used as an edge against which the front portion of the tube 27 can be torn away.

The manner of forming and sealing the top and bottom of the packet 20 is as described for the packet 10, a similar mandrel being used. The top and bottom tubes 27 and 28 may, of course, be secured to the body 30 after the latter has been formed, rather than as suggested above.

It will be understood that each of the packets 10 and 20 may be used without an outer hinged lid packet, in the same manner as the packets disclosed in the above mentioned application.

A packet 60 according to a third embodiment of the invention is shown in FIG. 6. The body of the packet consists of a tubular portion 61 sealed longitudinally at 62 and made from a blank of a laminated sheet of card and aluminium foil; this is similar to the body 30 of the second embodiment (FIG. 4).

The bottom of the body 61 is closed by a blank 63, made from a laminated sheet of paper and aluminium foil, which is longitudinally sealed at 63A to form a tube and secured to the inside surface of the body 61. The resultant tube is then sealed and folded in the same way as the tube 28, FIG. 5.

The top of the packet is formed by a cap 64 made from a laminated blank of an outer layer of aluminium foil with an inner layer of paper. A tear tab 65 is provided at the front of the cap to allow it to be pulled easily off the body 61. The cap 64 is similar to that disclosed in the above mentioned application.

The packet 60 may again be formed with the help of a mandrel. The blank for the body 61 is first formed into a tube around the mandrel, and the longitudinal seal 62 made. The cap 64 is next attached to the body 61, preferably by a soft, wax-like adhesive which will not offer too great a resistance when in use the cap is removed by pulling the tear tab 65. The mandrel, which may be of the contracting type, is then withdrawn, and the blank 63 secured to body 61. The packet can now be filled with cigarettes, and the blank 63 finally closed as described above.

Instead of the blank 63 being secured to the body after the latter is formed into a tube, a composite blank may initially be formed of the body 61 and the blank 63. In this case the respective longitudinal seals 62 and 63A will be in line, not displaced as shown in FIG. 6. However if preferred the blank for the body 61 may be made wider than the blank 63 in the composite blank, so that the seal 62 overlaps the seal 63A in the finished packet.

A composite blank could similarly be used in the case of the packet 20, FIGS. 4 and 5, the tubular portions 27 and 28 being secured respectively to the top and bottom ends of the blank for the body 30.

In the modification of the packet 60 shown in FIG. 7 the card body 61 is omitted and the relatively thin blank 63 is in effect, extended to the top of the packet, as shown at 66. The top of the packet is again closed by a cap 64.

A mandrel may again be used for this modified packet. After the longitudinal seal 66A has been formed on the mandrel, the cap 64 is secured as described above, and the mandrel is then withdrawn. The packet is next filled with cigarettes through the open bottom, which is finally closed and folded, as previously described.

If desired the packet 60, whether modified or not, may also be contained in an outer hinged lid packet, as in the case of the packets 10 and 20. This would provide extra protection for the cigarettes when the cap 64 has been removed. Alternatively, or additionally, the tear tab 65 may be arranged to one side of the packet 60, so that only a part of the cap 64 is opened and so that the ends of the cigarettes are not fully exposed.

We claim:

1. The combination of a hinged lid packet without an inner frame and arranged to open at one end and a packet for a substantially cuboid article having opposed end faces and comprising: two air-impervious tubes of rectangular section spaced apart by a gap, the tubes overlapping said opposed end faces of the article to provide a free end at each said face, each said free end being sealed flat up to the respective end face along a central plane parallel to one of the sides of the respective tube thereby forming a sealed margin of double thickness with triangulated portions at the ends thereof, said margin and said triangulated portions being folded over against the article; and a tubular body made from an air-impervious material which extends between the two end faces of the article and which is sealed to the outside surfaces of said tubes to bridge said gap therebetween, said packet being contained in the hinged lid packet and said tubular body being provided with a cut-out at the end corresponding to the opening end of the hinged lid packet to facilitate access to the contents of the packet.

2. The combination according to claim 1, in which the air-impervious tubular body adjacent said cut-out is provided with a tear tape which extends around the periphery of the tubular body away from said cut-out.

3. A packet for a substantially cuboid article having opposed end faces and comprising: two air-impervious tubes of rectangular section spaced apart by a gap, the tubes overlapping said opposed end faces of the article to provide a free end at each said face, each said free end being sealed flat up to the respective end face along a central plane parallel to one of the sides of the respective tube thereby forming a sealed margin of double thickness with triangulated portions at the ends thereof, said margin and said triangulated portions being folded over against the article; and a tubular body made from an air-impervious material which extends between the two end faces of the article and which is sealed to the outside surfaces of said tubes to bridge said gap therebetween.

4. A packet according to claim 3 wherein said tubular body comprises an air-impervious laminated sheet of card and aluminum foil.

5. A packet according to claim 3 in which each of said tubes is made of a laminated sheet of paper and aluminum foil which is longitudinally sealed, and the triangulated portions of each tube are folded on top of the respective margins against the respective end faces of the article.

* * * * *